US010935258B2

(12) United States Patent
Roy

(10) Patent No.: US 10,935,258 B2
(45) Date of Patent: Mar. 2, 2021

(54) FAN WITH COOLER

(71) Applicant: Sanjay K Roy, Miami, FL (US)

(72) Inventor: Sanjay K Roy, Miami, FL (US)

( * ) Notice: Subject to any disclaimer, the term of this patent is extended or adjusted under 35 U.S.C. 154(b) by 115 days.

(21) Appl. No.: 16/256,174

(22) Filed: Jan. 24, 2019

(65) Prior Publication Data

US 2019/0277514 A1 Sep. 12, 2019

Related U.S. Application Data

(60) Provisional application No. 62/641,575, filed on Mar. 12, 2018.

(51) Int. Cl.

| | |
|---|---|
| ***F24H 3/06*** | (2006.01) |
| ***F24F 1/0287*** | (2019.01) |
| ***F04D 25/16*** | (2006.01) |
| ***F24F 1/029*** | (2019.01) |
| ***F04D 25/08*** | (2006.01) |
| ***F04D 29/58*** | (2006.01) |
| ***F04D 19/00*** | (2006.01) |

(52) U.S. Cl.

CPC ..... *F24F 1/0287* (2019.02); *F04D 19/002* (2013.01); *F04D 25/088* (2013.01); *F04D 25/166* (2013.01); *F04D 29/5826* (2013.01); *F24F 1/029* (2019.02)

(58) Field of Classification Search

CPC .... F04D 19/002; F04D 25/088; F04D 25/166; F04D 29/582; F04D 29/5826; F24F 1/029; F24F 1/02; F24F 1/022; F24F 1/0317; F24F 1/028; F25B 1/00; F25B 13/00; F25B 30/00

See application file for complete search history.

(56) References Cited

U.S. PATENT DOCUMENTS

| | | | | |
|---|---|---|---|---|
| 4,827,733 | A | 5/1989 | Dinh | |
| 5,146,762 | A | 9/1992 | Atkins | |
| 5,460,004 | A | 10/1995 | Tsimerman | |
| 5,979,167 | A | 11/1999 | Kochavi et al. | |
| 6,116,037 | A | 9/2000 | Burnett | |
| 6,318,104 | B1 | 11/2001 | Moraes et al. | |
| 6,560,968 | B2 * | 5/2003 | Ko | F04D 29/582 62/3.2 |
| 7,216,492 | B2 | 5/2007 | Sellers | |
| 7,322,208 | B1 | 1/2008 | Griffin | |
| 7,513,126 | B2 | 4/2009 | Boland | |
| 7,537,015 | B1 | 5/2009 | Molnar, IV et al. | |
| 7,908,879 | B1 | 3/2011 | Chen | |
| 9,790,948 | B2 | 10/2017 | Liu | |
| 9,797,413 | B2 | 10/2017 | Stewart et al. | |
| 9,816,515 | B2 | 11/2017 | Iwamoto et al. | |
| 2008/0245083 | A1 * | 10/2008 | Tutunoglu | F25B 49/02 62/115 |
| 2017/0328585 | A1 * | 11/2017 | Yanase | F24F 1/26 |
| 2019/0154299 | A1 * | 5/2019 | Jewell | F24F 1/029 |

OTHER PUBLICATIONS

Outpost site requirements—AWS Outposts https://docs.aws.amazon.com/outposts/latest/userguide/outposts-requirements.html Retrieved Oct. 12, 2020.

* cited by examiner

*Primary Examiner* — Henry T Crenshaw
*Assistant Examiner* — Kamran Tavakoldavani

(57) ABSTRACT

A fan with an integrated cooler is disclosed. Unlike conventional air-conditioners, the device is compact and lightweight, and can be used both indoors and outdoors without the need to enclose or otherwise control the user environment from thermal considerations.

14 Claims, 1 Drawing Sheet

Schematic diagram of preferred embodiment of invention
(Arrows show general direction of air flow)

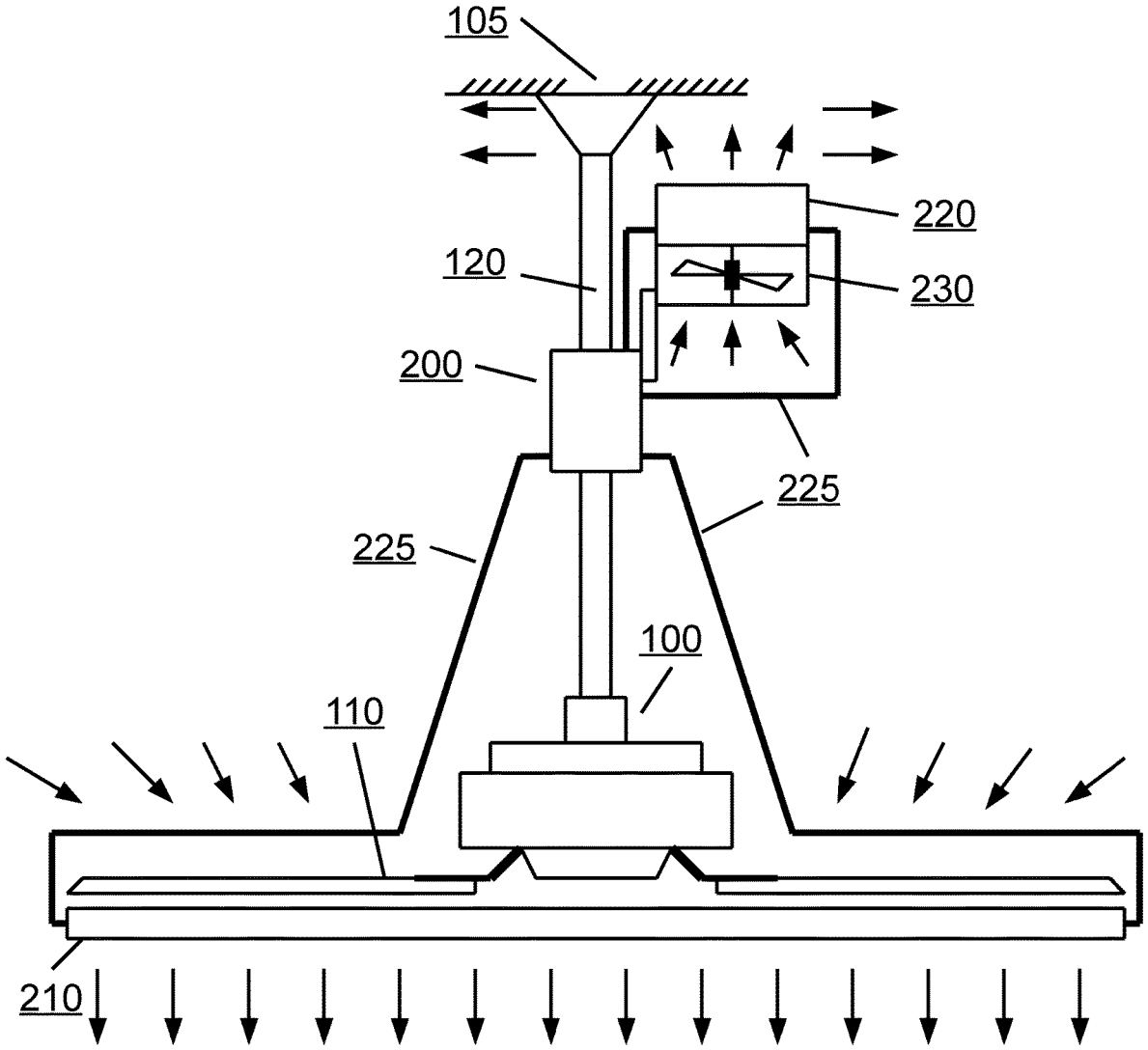
Schematic diagram of preferred embodiment of invention
(Arrows show general direction of air flow)

FAN WITH COOLER

RELATED APPLICATION

This application claims the benefit of U.S. Provisional Appl. Ser. No. 62/641,575 filed on Mar. 12, 2018—the contents of which are incorporated by reference herein.

FIELD OF INVENTION

This disclosure is in the field of electric fans used for circulating air to enhance comfort. It is also related to air-conditioning units used for space cooling and heating.

BACKGROUND OF THE INVENTION

Air-conditioning is a hallmark of modern society allowing comfortable indoor conditions to be maintained at all times regardless of the outdoor environment. Though the invention addresses both cooling and heating, the focus is primarily on the cooling aspect, i.e. maintaining comfort conditions when the outdoor air temperature is relatively high. Excessively warm temperatures are typical not only in tropical and sub-tropical environments, but they are also encountered in temperate regions during the summer months. As a result, air-conditioning systems of various types and configurations have been developed.

Air-conditioning systems are designed primarily for a controlled, enclosed environment. In the absence of air-conditioning, indoor temperatures approach the outdoor temperatures due to constant energy/heat transfer through the building envelope. To maintain lower temperatures in the conditioned space (i.e. when the "air-conditioner" is operating in the cooling mode), it is therefore necessary to continuously remove energy from this (cooled) space and transfer it back to the (warmer) external environment. Thus, an air-conditioning system in its cooling mode functions as a "refrigerator" that is used to absorb energy from the cool indoor air and dissipate it to the warmer exterior air. Note that such a "refrigerator" can be also used as a "heat-pump" to add heat to an indoor space from a colder exterior when heating is necessary. Alternatively, heating can be accomplished by directly adding thermal energy (via combustion or electrical heating) to the enclosed space, which is a simpler, though energetically more costly approach.

DESCRIPTION OF THE PRIOR ART

Various types of air-conditioning systems are available, e.g. "central" systems that are used to cool entire buildings (or large sections of a building), "room air-conditioners" that are used to cool smaller spaces such as a single room, designs for mobile applications (e.g. cars and other vehicles), "portable" units (e.g. for temporary localized cooling of indoor or outdoor spaces), etc. These may be based on different types of closed-cycle technologies, e.g. vapor compression, vapor absorption, thermoelectric, etc., though vapor compression units are the most common. For a given application, an appropriate air-conditioning system is therefore selected based on a large number of criteria (e.g. size, weight, cooling capacity, cost, etc.). Note also, that air-conditioning systems for industrial equipment (e.g. computer cabinets) are also available—however, these are designed for use with specific products and cannot be directly used for human comfort applications.

The cost (both initial and operating) of conventional air-conditioning systems limits their use in many applications. When this is the case, alternative methods using a disposable "coolant" are often used. These are mostly variations of evaporative cooling, where the ("dry bulb") temperature of the air is reduced by using energy from the air itself to evaporate water that is added (sprayed or otherwise) into the air stream. Evaporative coolers of varying types/designs (e.g. direct or indirect, systems using regenerative materials such as desiccants, etc.), configurations and sizes are available. These can be used to cool regions as large as entire buildings (as in conventional central air-conditioning systems) or as small as the shaded area beneath an outdoor umbrella.

The two options ("air-conditioner" or "evaporative cooler") above cover a vast majority of use cases. However, size, weight, system complexity and cost make conventional systems impractical when air-cooling is desirable only for limited periods of time. This is often the case in specific seasons (e.g. mid-summer in the higher northern or southern latitudes) and in certain types of environments (e.g. outdoors in the shade, indoors in structures with large thermal capacities). Under these circumstances, an electrically powered (typically) "household" type fan is another option. These function by increasing the air circulation, thereby enhancing heat transfer (due to the higher air speeds). In this approach, comfort conditions are achieved without actually reducing the ambient temperature (except when the air is otherwise stagnant). When lower temperatures are necessary, further cooling of the air may be achieved by transferring energy to a previously refrigerated substance such as cold water or ice or by using evaporative cooling (e.g. water sprays/mists, etc.).

There are a number of limitations and constraints associated with current air-conditioning (cooling) systems used to maintain comfort conditions. Some of these include the following:

a. Conventional closed-cycle air-conditioning systems are too heavy, large and expensive for small-scale cooling applications. This is due to the design philosophy itself—since conventional air-conditioners are used to cool enclosed air spaces in their entirety, they must have a high enough capacity to absorb all the excess heat within the enclosure (i.e. the building, vehicle, etc.) and dissipate it outside during operation. Thus, even smaller room, vehicular and portable systems have cooling capacities of a few kW, and are designed with separate sections that transfer heat from the interior, enclosed space to the exterior ("portable" units have large, extended ducts to dissipate excess heat to a region away from the conditioned space). The overall result is increased complexity and a relatively high size, weight and cost.

b. Evaporative coolers that are used to cool large buildings can be as (or more) complex as conventional closed-cycle air-conditioning systems. However, smaller evaporative coolers can be relatively compact and inexpensive, and such devices are available for both indoor and outdoor applications. Nevertheless, a number of factors limit their use, in particular: a) a requirement of a continuous supply of water (for direct/indirect systems), b) biofouling issues after extended use, c) limited-to-no cooling effect in regions with high relative humidities (for direct systems), and d) a need for a heat source for systems that use a regenerative material.

c. Fans do not cool the air though they may reduce temperatures locally by improved mixing when the air is otherwise stagnant. Thus, only limited improvements in comfort conditions can be achieved since excessive air speeds result in draft which can make the environment too uncomfortable for human occupancy. Fans augmented by evaporative cooling are an acceptable alternative, but they suffer from the disadvantages of all evaporative cooling systems. Similarly, fans augmented by a cold substance such as ice or cold water are adequate only for limited durations since this requires a separate source of the cold substance.

Based on the above, it is clear that current systems are useful only for the following types of applications:

a) maintaining comfort conditions in enclosures where size/weight/cost and "enclosed space" related constraints are acceptable, b) cooling areas where problems associated with evaporative cooling (particularly those related to relative humidity) are manageable, and c) providing localized comfort conditions where the ambient conditions are such that a cooling effect can generally be obtained via a limited increase in air circulation.

SUMMARY OF THE INVENTION

Based on prior art, it is clear that there is a need for a simple air cooling system that can be used to provide comfort conditions while overcoming the constraints of current products. In achieving this goal, this invention comprises the following:

a. an "household" type electric fan (i.e. an appliance used to enhance comfort via increased air circulation) that is used to circulate air locally, and b. an integrated miniature vapor compression refrigeration unit with a cooling capacity no greater than 500-600 W, with its cooling coil positioned such that it cools the fan-blown air.

The critical feature of this invention is the integration of a conventional "household" type fan with a refrigeration unit that has a cooling capacity that is far lower (few hundred watts or less) than those of conventional systems (of the order of kilowatts). This provides the invention with a number of features that are not available in any prior art:

a. The heat dissipated by the refrigeration system is similar to the heat generated by a few incandescent lamps (see detailed description). This heat can be dissipated internally near the device and absorbed by the ambient air since it is an order of magnitude lower than those in conventional systems. Thus, unlike conventional approaches, a separate outdoor heat dissipation system or special ducts are not required. This results in a device that is far less complex and has a much lower cost. The low cooling capacity of the refrigeration unit also allows the overall unit to be compact and lightweight like "household" fans.

b. The operating condition for the device is open from an air-change perspective since the dissipated heat is absorbed by the ambient air, and there is no need to enclose or otherwise control the user environment (i.e. the cooled space) from thermal considerations. The invention can therefore be used both indoors and outdoors like "household" fans, and complexities/problems associated with conventional air-conditioning systems (e.g. minimization of air/thermal leaks, air quality issues due to filter and/or duct biofouling) are completely eliminated.

Note that the use of a very low cooling capacity refrigeration unit (similar to that of the present invention) is not novel by itself since a "conventional" air-conditioner with very low cooling capacity is an obvious solution for providing comfort conditions in very small enclosures (e.g. cabins). However, unlike this "enclosed space" approach of a room air-conditioner, the present invention is novel since it successfully provides comfort conditions in a local region in a generally (large) open space. Such a device is not available commercially and has not been disclosed in prior art (though many other approaches have been used with limited success, e.g. an umbrella with evaporative cooling).

BRIEF DESCRIPTION OF THE DRAWINGS

FIG. 1 is a schematic diagram of the preferred embodiment of the disclosed invention. The arrows in the FIGURE show the general direction of air-flow.

DETAILED DESCRIPTION

FIG. 1 shows a preferred embodiment of the invention. It comprises the following:

a) a ceiling-fan (100), i.e. a fan mounted on the ceiling (105) that is used to enhance air circulation locally in the region beneath it, and b) a miniature vapor compression refrigeration unit (200) with a cooling capacity of 100-300 W (at a temperature difference of the order of 20-30 C between its evaporator (210) and condenser (220)).

The refrigeration unit is mounted above the fan blades (110) on the support structure/rod (120) of the fan assembly. Its evaporator (210) and condenser (220) are placed separately from each other and connected to the rest of the unit via tubing (225) which may be insulated. The heat absorption section of the refrigeration unit (its evaporator/cooling coil (210)) is positioned primarily below/adjacent to the fan blades (110) so that the air forced downwards by the fan (100) blows over it dissipating heat to the evaporator (210) in the process. The air circulated by the fan (100) to the region beneath it (i.e. the "conditioned space") is now at a temperature that is below the ambient. Heat dissipation from the refrigeration unit occurs at the condenser (220) that is placed well above the fan. This is accomplished using a second dedicated fan (230) that forces air past the condenser (220) such that it flows in a direction away from the cooled region directly beneath the fan (100) (the arrows in FIG. 1 show general air-flow directions).

It is important to note that the total heat dissipated from the refrigeration unit (200) is approximately equal to the sum of the heat absorbed by the evaporator (210) and the power used to drive the refrigeration system. In the preferred embodiment, this will be of the order of 130-450 W since the power required by the refrigeration unit will be of the order of 30-150 W (the overall coefficient of performance of a miniature vapor compression unit will be ~2-3 for a temperature difference of ~20-30 K). This quantity of heat (equivalent to that released by a few incandescent bulbs) can be readily removed from a room or an outdoor space to the wider environment without any additional equipment. As a result, the average temperature of operation and performance of the device will remain approximately constant regardless of whether it is used indoors or outdoors (as long as the wider environmental conditions do not change). Note that this will not be the case if the invention is used in a well-sealed, enclosed space with minimal air changes as is the situation with conventional air-conditioning systems, but this is a not an issue for the present application.

In its simplest form, the evaporator (210) comprises one or more tubes with the heat transfer fluid (i.e. the refrigerant in the preferred embodiment). These may be configured such that the tube/coil assembly functions as a "fan safety grill" to minimize the possibility of accidental contact with the fan blades during operation. The heat dissipation condenser (220) and its dedicated fan (230) on the other hand can be a simple design comprising a quiet, compact, lightweight radiator-fan assembly that will maximize heat transfer with minimum power usage.

The preferred embodiment described above can be modified to include a number of features that may provide other benefits such as improved performance and/or lower cost. Some of these include the following:

a. For better performance, enhanced surfaces (e.g. fins (or decorative features that function as fins) to increase the heat transfer area and/or the degree of turbulence) are added to the evaporator tubes. This will increase the overall heat transfer for a given air flow rate and result in lower air temperatures that more closely approach that of the cooling coil. Further enhancements can include stationary blades and/or shrouds to improve the flow and heat transfer characteristics, but these may be incorporated in the most exceptional of cases.

b. Other embodiments may use other types of "household" fans, e.g. personal fans, pedestal fans, wall-mounted fans, tower fans, floor fans, box fans, window fans, drum fans, blower fans, etc. As in the ceiling fan design, the evaporator/cooling coil can be placed primarily in front of the rotating blades and function as a safety grill/"finger-guard". The heat dissipation radiator-fan assembly can be positioned facing the rear or an alternate direction that does not interfere with the main air-flow. The position of the refrigeration unit may also be changed, e.g. for a pedestal fan, it may be advantageous to place the refrigeration unit at the base of the pedestal to enhance stability and extend the cooling coils up to the face of the fan. However, it is important to note here that in the context of the claims, a "fan assembly" is defined as a type of appliance/"household" type fan (with multiple rotating blades or otherwise) that is generally used to circulate air in an outdoor or indoor living space to enhance human comfort (i.e. a small subset of the more general mechanical/aerospace engineering defined "fan", which comprises a device for moving high volumes of a gas with low increase in its pressure ("high" and "low" are relative to other devices in the same family such as compressors)).

c. Oscillating systems are also possible for the different configurations. In this case, the evaporator/cooling coil and/or the heat dissipation assembly must be connected to the refrigeration unit via flexible tubing/connectors to ensure proper functioning.

d. For compact designs, i.e. where the distance between the evaporator/cooling coil and the secondary fan-radiator heat dissipation assembly is relatively small, it may be advantageous to place baffles next to the heat dissipation assembly to minimize any mixing between the incoming air to the fan(s) and the exhaust from the heat dissipating radiator. This will not be necessary in the preferred embodiment but may be useful in a wall-mount configuration.

e. Another form of the preferred embodiment would use a hollow support and a hollow shaft motor for the fan. The cooling coil is then routed to the front of the fan through the hollow shaft, and the refrigeration unit and heat dissipation assembly can be placed within the hollow support (note that the support must have slots to allow for air flow). This makes the external appearance more pleasing and the air used for heat dissipation can be vented to the rear (and possibly into an attic space for a ceiling fan configuration.

f. Though the preferred embodiment has a cooling capacity of 100-300 W, higher capacity (~300-600 W) embodiments are viable for larger outdoor and semi-open warehouse type locations. Similarly, lower capacity (<100 W) may also be useful when limited cooling is required. Note that the overall configuration of such embodiments will be the same as in the preferred case. However, versions with cooling capacities greater than ~600 W are not expected to be practical due to the larger size/weight of the refrigeration unit and the increased heat dissipation requirements (that will likely affect the cooled environment adversely).

g. An alternative embodiment is possible using a thermoelectric cooling system instead of a vapor compression system. However, this will likely be viable only for low cooling capacity units due to the poor coefficient of performance of current thermoelectric modules/coolers (typically below 1) which results in significantly higher heat dissipation requirements as compared to vapor compression systems.

h. A modular, but more complex embodiment may incorporate a secondary loop for the cooling coil and/or the heat dissipation coil. In this approach, the refrigeration unit is coupled to the secondary loop(s) via a heat exchanger(s). Note that this embodiment will require a pump(s) for the secondary loop and the overall system will be more complex and likely have increased size, weight and cost. As a result, this is not a preferred embodiment, except possibly when a thermoelectric refrigeration unit is used.

i. An embodiment that has lower power consumption is possible by replacing the fan-radiator heat dissipation assembly by a passive radiator (that incorporates a thermo-siphon or a heat pipe, etc.). However, this embodiment may be viable only for units with lower cooling capacity and where a larger unit size will be acceptable. Such a unit may also be less versatile as orientation of a passive radiator is often critical (e.g. for thermo-siphons).

j. In addition to its cooling focus, this invention can also incorporate a heating mode. This is accomplished by operating the refrigeration unit (200) such that it functions as a heat-pump, i.e. by redirecting the refrigerant flow within the unit so that the "evaporator" (210) functions as the heat dissipation (i.e. a condensing) section and the "condenser" (220) functions as the heat absorption (i.e. a evaporating) section. This variation of the invention will find additional use for fall/winter heating, though at a higher cost (due to the greater complexity of a dual refrigerator-heat pump configuration).

k. A final version of the invention is a purely heat-pump version that is used only for local heating instead of cooling. As in the previous (cooling) cases, this embodiment will be practical only for limited heating loads. In this case, the main benefit is a reduced power consumption compared to the conventional approach for local heating applications (viz. electrical heating).

Details of the refrigeration (and heat-pump) unit itself, the power source (e.g. systems may be powered by solar energy for outdoor units), the control system, etc. have not been described above since many variations are feasible based on prior art. Thus, while the invention has been described and disclosed in various terms or certain embodiments, the scope of the invention is not intended to be, nor should it be deemed to be limited thereby, and such other modifications or embodiments as may be suggested by the teachings herein are particularly reserved especially as they fall within the breadth and scope of the claims here appended.

What is claimed is:

1. An air cooling system for circulating air cooled to a temperature below ambient in a space open to the external environment, comprising a fan and a refrigeration unit utilizing a vapor compression cooling cycle, said fan comprising one of a ceiling fan, a personal fan, a pedestal fan, a wall-mounted fan, a tower fan, a floor fan, a box fan, a window fan, a drum fan, a blower fan or an oscillating fan, said refrigeration unit being integrated with said fan utilizing a support structure and comprising a compressor, a connecting tubing, a heat absorption evaporator, a heat dissipation condenser and a secondary heat dissipation fan, wherein said fan, said compressor, said connecting tubing, said heat absorption evaporator, said heat dissipation condenser and said secondary heat dissipation fan are all positioned in said space, said heat absorption evaporator being positioned adjacent to said fan such that air circulated by said fan passes over said heat absorption evaporator, said heat dissipation condenser being positioned adjacent to said secondary heat dissipation fan such that air circulated by said secondary heat dissipation fan is forced to pass over said heat dissipation condenser, wherein said heat absorption evaporator and saki heat dissipation condenser both exchange heat with air from said space, with said secondary heat dissipation fan being positioned such that its exhaust air is directed away from air incoming to said fan, and with said refrigeration unit having a cooling capacity not greater than 300 W when the temperature difference is not less than 20 K or greater than 30 K between said heat absorption evaporator and sad heat dissipation condenser.

2. The air cooling system of claim 1, wherein said heat absorption evaporator is configured to function as a finger-guard.

3. The air cooling system of claim 1, wherein said heat absorption evaporator has at least one heat transfer enhancement feature.

4. The air cooling system of claim 1, wherein said heat dissipation condenser and said secondary heat dissipation fan are an integrated radiator-fan assembly.

5. The air cooling system of claim 1, wherein said refrigeration unit comprises flexible tubing.

6. The air cooling system of claim 1, wherein said refrigeration unit can function as a heat-pump with said heat absorption evaporator functioning as the heat dissipation/condensing section and said heat dissipation condenser functioning as the heat absorption/evaporating section.

7. An air cooling system for circulating air cooled to a temperature below ambient in a space open to the external environment, comprising a fan and a refrigeration unit utilizing a vapor compression cooling cycle, said fan comprising one of a ceiling fan, a personal fan, a pedestal fan, a wall-mounted fan, a tower fan, a floor fan, a box fan, a window fan, a drum fan, a blower fan or an oscillating fan, said refrigeration unit being integrated with said fan utilizing a support structure and comprising a compressor, a connecting tubing, a heat absorption evaporator, a heat dissipation condenser and a secondary heat dissipation fan, wherein said fan, said compressor, said connecting tubing, said heat absorption evaporator, said heat dissipation condenser and said secondary heat dissipation fan are all positioned in said space, said heat absorption evaporator being positioned adjacent to said fan such that air circulated by said fan passes over said heat absorption evaporator, said heat dissipation condenser being positioned adjacent to said secondary heat dissipation fan such that air circulated by said secondary heat dissipation fan is forced to pass over said heat dissipation condenser, wherein said heat absorption evaporator and said heat dissipation condenser both exchange heat with air from said space, with said secondary heat dissipation fan being positioned such that its exhaust air is directed away from air incoming to said fan, and with said refrigeration unit having a cooling capacity not less than 300 W and not greater than 600 W when the temperature difference is not less than 20 K or greater than 30 K between said heat absorption evaporator and said heat dissipation condenser.

8. The air cooling system of claim 7, wherein said heat absorption evaporator is configured to function as a finger-guard.

9. The air cooling system of claim 7, wherein said heat absorption evaporator has at least one heat transfer enhancement feature.

10. The air cooling system of claim 7, wherein said heat dissipation condenser and said secondary heat dissipation fan are an integrated radiator-fan assembly.

11. The air cooling system of claim 7, wherein said refrigeration unit comprises flexible tubing.

12. The air cooling system of claim 7, wherein said refrigeration unit can function as a heat-pump with said heat absorption evaporator functioning as the heat dissipation/condensing section and said heat dissipation condenser functioning as the heat absorption/evaporating section.

13. An air cooling system for circulating air cooled to a temperature below ambient in a space open to the external environment, comprising a fan and a refrigeration unit, said fan comprising one of a ceiling fan, a personal fan, a pedestal fan, a wall-mounted fan, a tower fan, a floor fan, a box fan, a window fan, a drum fan, a blower fan or an oscillating fan, said refrigeration unit being integrated with said fan utilizing a support structure and comprising a heat absorption means, a heat dissipation means and a secondary heat dissipation fan, wherein said fan, said support structure, said heat absorption means, said heat dissipation means and said secondary heat dissipation fan are all positioned in said space, said heat absorption means being positioned adjacent to said fan such that air circulated by said fan passes over said heat absorption means, said heat dissipation means being positioned adjacent to said secondary heat dissipation fan such that air circulated by said secondary heat dissipation fan is forced to pass over said heat dissipation means, wherein said heat absorption means and said heat dissipation means both exchange heat with air from said space, with said secondary heat dissipation fan being positioned such that its exhaust air is directed away from air incoming to said fan, and with said refrigeration unit having a cooling capacity not greater than 600 W.

14. The air cooling system of claim 13, wherein said refrigeration unit is one of a vapor compression refrigerator or a thermoelectric refrigerator.

* * * * *